United States Patent [19]

Barnes et al.

[11] Patent Number: 4,669,521

[45] Date of Patent: Jun. 2, 1987

[54] CHILDREN'S EXPANDABLE GATE WITH SAFETY FEATURES TO PREVENT HEAD AND NECK ENTRAPMENT

[75] Inventors: Garrison C. Barnes, Kenosha, Wis.; Russell H. Bullard, Hernando, Miss.; Robert C. Weber, Hales Corners, Wis.

[73] Assignee: Worldsbest Industries, Inc., Memphis, Tenn.

[21] Appl. No.: 895,160

[22] Filed: Aug. 11, 1986

Related U.S. Application Data

[63] Continuation of Ser. No. 708,354, Mar. 5, 1985, abandoned.

[51] Int. Cl.[4] ..... E06B 3/92

[52] U.S. Cl. ..... 160/136; 160/162

[58] Field of Search ..... 160/160, 161, 162, 136

[56] References Cited

U.S. PATENT DOCUMENTS

| | | | |
|---|---|---|---|
| 285,140 | 9/1883 | Körner | 160/161 |
| 358,956 | 3/1881 | Bataille | 160/144 |
| 417,898 | 12/1889 | Bataille | 160/141 |
| 447,102 | 2/1891 | Bushman | 160/161 |
| 448,314 | 3/1891 | Bataille | 160/162 |
| 514,663 | 2/1894 | Pitt | 160/136 |
| 871,905 | 11/1907 | Acers | 160/162 X |
| 1,276,100 | 8/1918 | Niznik | 160/135 |
| 1,635,601 | 7/1927 | Benca | 160/161 |
| 1,934,164 | 11/1933 | Brown | 160/162 |
| 2,001,181 | 5/1935 | Burcham | 49/55 |
| 2,310,539 | 2/1943 | Nelson et al. | 160/159 |
| 2,348,561 | 5/1944 | Mutch | 160/135 |
| 2,442,937 | 6/1948 | Roman | 160/144 |
| 2,928,146 | 3/1960 | Kuniholm | 49/55 |
| 4,149,342 | 4/1979 | Bowers | 49/55 |

FOREIGN PATENT DOCUMENTS

| | | | |
|---|---|---|---|
| 248840 | 7/1911 | Fed. Rep. of Germany | 160/138 |

OTHER PUBLICATIONS revised Draft of ASTM Task Group F15-21 "Expansion Gates & Expandable Enclosures", Sep. 19, 1984.

CPSC Staff Suggested Requirement and Test Procedure to Address Head Entrapment in Partially Bounded Openings in the Top Edge Products Within the Scope of the voluntary Standard for Gates and Enclosures, Feb. 20, 1985.

*Primary Examiner*—Ramon S. Britts

*Assistant Examiner*—Cherney S. Lieberman

*Attorney, Agent, or Firm*—Milton S. Gerstein; Marvin N. Benn

[57] ABSTRACT

A children's expandable, accordian-type gate is disclosed which includes safety features for closing off the open, upper V-shaped openings of the latticework of the gate, which latticework is comprised of a first series of slats parallel to each, and a second series of salts parallel to each other but angularly oriented differently from the first series. The upper V-shaped openings are closed off by upper extensions of the slats forming the boundaries of the V-shaped openings, which extensions project above the two, mutually-pivoted upper slat-ends from two adjacent V-shaped openings. The lower portions of the latticework of the gate may be positioned an approximate constant elevation above the floor or support above which it extends by the provision of sliding mounting brackets for the upper portions of the latticework which allow sliding movement thereof relative to the end posts, while the lower portions of the latticework are provided only with a pivot attachment that prevents such sliding movement relative to the end posts. Further, there may be provided a central leg brace or support for shoring up the center portions of the lattice-work, especially when extra-long gates are employed. Such leg brace has a first upper end pivotally connected to the upper vertex of a lower diamond-shaped opening of the lattice-work, and has a lower end that is slidingly connected to the lower vertex of the same diamond-shaped opening by the pivot pin that pivotally connects the slat-ends forming the lower vertex of the diamond-shaped opening.

5 Claims, 18 Drawing Figures

16'
25
23
24"
37
30
22'
30'
22
37
24"
37'
37'
10
37
12'
20'
17
16
18
16"
41
38
30
38
12
43
38
3
49'
14
42
11
36
51
48
11
36
38
11
40
52
3

20'
16'
20
17
18
18'
18"
22'
30'
37
30
22
37
37
38
30
43
14
12'
12
41

22
30
49'
50
49
48
51
51
49"
50'
52

122'
100
104
98
98
98
90
92
96
12'
122
122
106
37
37
95
30
22
94
36
36
12
14
138
12'

132
120
128
100
98
98
95
12'
108
106
102
30
22
94
12
110
112
14
114

22
130
98
102
14
92
14
122'
104
108
14

CHILDREN'S EXPANDABLE GATE WITH SAFETY FEATURES TO PREVENT HEAD AND NECK ENTRAPMENT

This application is a continuation, of application Ser. No. 708,354, filed Mar. 5, 1985, now abandoned.

BACKGROUND OF THE INVENTION

The present invention is directed to a children's expansion gate for closing off room openings, doorways, entrance ways, and the like, to prevent passage therethrough by children, and to keep them confined in a desired general area. Such expansion gates are typically used for children between the ages of 6 months and 24 months. The gates expand to fit the size of the opening which is to be closed off. In its desired, expanded position, the gate is locked in place relative to the walls forming the opening, so as to preclude forced removal by a child attempting to enter the closed-off room, space, hallway, or the like.

However, the conventional children's expansion gate heretofore used has been a source of considerable danger and risk to the very children it is supposed to protect. The problem has arisen due to the openings formed in accordian-type children's gates, which openings are generally diamond-shaped. These openings have allowed children to insert their heads therein, with the ofttimes concomitant entrapment therein, causing injury. Further, currently-available children's expansion gates also have V-shaped cut-outs formed at the top of the gate, which have been responsible for many deaths to children, since a child will often insert his or her neck therein, and not be able to remove it. If the gate is contracted during such condition, strangulation of the child may occur.

Recently, the Consumer Product Safety Commission has banned the sale of these children's expandable gates, as well as children's expandable enclosures, from which the above-enumerated danger is present. New safety standards have recently been proposed by the American Society of Testing and Materials (ASTM) by which the area of the diamond-shaped openings and the angular extension of the V-shaped cut-outs would have to conform to size and configuration that does not allow the inserting therein of a head or neck of a child between the ages of 6 months and 24 months. Such standards would require the V-shaped cut-outs to have an angular expanse, in the gate's most extended position, of at least 70 degrees, and each diamond-shaped opening small enough to prevent a template from entering therein, which template provides the minimum size and dimensions of a child's head and neck to ensure that no child between the ages of 6 months and 24 months could get his or her head caught therein. These standards also would require that the distance from the floor or support, above which the gate or enclosure projects, to the lowermost point of the upper surface of the gate to be at least 22 inches. Further, it also would require that the distance from the floor or support to the highest point on the lowermost surface of the gate or enclosure to be such that it would not admit of the template used to test the size of the diamond-shaped openings, to prevent a child's head from becoming entrapped between the floor and the bottom of the gate or enclosure.

SUMMARY OF THE INVENTION

It is, therefore, the primary objective of the present invention to provide a children's expandable, accordian-style gate having safety features thereon that prevent access to the potentially hazardous diamond-shaped and V-shaped openings of the gate.

It is another objective of the present invention to provide such features in a way that protection to small children is provided in a simple, fast, and efficient manner, such that the very expanding of the gate itself automatically provides such protection, with little or no additional effort necessary by the user of the gate above that normally and heretofore employed for conventional expandable gates.

It is still another objective of the present invention to prevent access through the space defined between the floor, or support, above which the expandable gate projects, and the bottom portion of the accordian-style latticework of the gate, which have hitherto been causes for the existence of hazardous conditions in the conventional children's expandable gate.

It is yet another objective of the present invention to allow for such preventive safety measures for the space between the bottom portion of the gate and the floor above which it extends to be automatic and self-realizing as the gate is expanded to its closing-off state across an entranceway, opening, or the like.

It is still another objective of the present invention to provide for a very long, expandable gate with a central, lower, floor-supported leg brace helping to sustain the girth of the latticework of the gate to provide structural integrity thereto, so as to prevent buckling thereof, and the like.

Toward these above-ends, as well as others, the children's expandable gate of the present invention, in its preferred embodiment, includes angularly and upwardly projecting extensions of the upper ends of the elongated members or slats forming the upper, open V-shaped openings in the latticework of the gate, which upwardly-projecting extensions cause the open V-shaped openings to be closed off from above as the latticework of the gate is expanded. Each upwardly-projecting extension originates at the upper end of each leg delimiting the V-shaped openings, which upper end is pivotally connected to an upper end of a directly adjacent leg forming a boundary of the directly adjacent V-shaped opening closest to the leg. As the gate is expanded or contracted, the extensions prevent access to the V-shaped opening from above, and reduce the otherwise-large area formed by V-shaped openings, as bounded by its two legs thereof, to a fraction thereof.

To ensure that the lowermost, bottom portion of the latticework of the children's expandable gate is not elevated above the floor, or support, above which it projects, more than would admit of a child's head or neck, the lower ends of a pair of latticework-end associated slats, which form part of the latticework, are connected to the lower ends of the end posts of the gate, in a pivotal, non-sliding relationship, one slat-end being pivotally connected to the lower end of one end post, and the other slat-end being pivotally connected to the lower end of the other end post. A different pair of latticework-end associated slats are connected at ends thereof to the upper portions of the end posts, such connection being a sliding one, so that as the latticework expands and contracts, each end of the different pair of slats may slide downwardly and upwardly, respectively, along its respective end post.

The central portion of the latticework of the gate, in the preferred embodiment, is provided with a vertically-oriented leg-brace or support for shoring up the middle portions of the latticework as it is extended to its expanded state or states. The leg-brace is pivotally connected at its upper portion to an upper vertex of one of the central, diamond-shaped openings in the latticework, while the other, lower portion of the leg-brace is provided with a slot in which rides an enlarged head projecting from the pivot pin forming the lower vertex of the same diamond-shaped opening. The enlarged head slides relative the slot as the gate is expanded or contracted. The lowermost portion of the leg-brace is provided with a foot or pad for support upon the floor or ground, above which the gate extends.

In the second embodiment of the invention, the open V-shaped openings are closed off at the tops thereof by a plurality of individual, distinct and slotted channel members, each being mounted along the upper portion of a V-shaped opening to close it off. Half of the channel members is positioned on one side of the latticework, while the other half is positioned on the other side of the latticework. In the most-expanded state, each channel member is positioned between two adjacent upper ends of the elongated members forming the legs of its respective V-shaped opening via pins, which pins project from the pivot pins pivotally connecting the upper ends of the elongated members or slats. The channel members lie in different vertical planes, so that when the gate is contracted and collapsed, the channel members of each side of the latticework are juxtapositioned next to each other, in side-by-side relationship. The pins ride in the slots of the channel members, to permit relative sliding movement therebetween to permit contraction and collapse of the gate's latticework.

In the third embodiment of the invention, the open V-shaped openings are closed off by a lever arrangement having a first lever arm pivoted at its first end to one of the end posts. A second lever arm is also provided, and is connected at one of its end to the second end of the first lever arm, such that relative sliding movement may occur between the two lever arms. The other end of the second lever arm is provided with an eye-hook which receives therethrough a vertically-oriented rod affixed to the other end post. The rod runs parallel to the height of the other end post. As the latticework of the gate is expanded, the second lever arm is pulled away from the first lever arm until stops, provided on the ends of the lever arms not connected to an end post, limit such relative movement, whereupon any further expansion of the latticework cause the lever arrangement to pivot about the first end of the first lever arm until the lever arrangement lies substantially horizontally at the tops of the open, V-shaped openings, to thus close them off. A locking U-shaped bracket is also provided, and is affixed to upper ends of at least a pair of the slats of the latticework, the adjoining ends of the two lever arms being confined therein during outward-most expansion of the gate, to thus provide an easily releasable locking member to hold the lever arrangement in its horizontally oriented position to close off the tops of the V-shaped openings and to remove from sight the limit stops on the adjoining ends of the lever arms.

In a fourth embodiment of the invention, the open V-shaped openings are closed off by an extensible cord, such as a rope, which cord is supplied from a block-and-tackle type supply. The supply is mounted within the hollow interior of one of the end posts, and pays out the cord as the end post is moved relative to the other end post, since the distal end of the cord is fixedly connected to the upper portion of the other end post. Biasing means in the supply tend to take up the cord when the end post is allowed to move relative to the other end post. A detent operatively associated with the upper end of the one end post, directly above the supply, is provided to prevent the return of the cord to the supply for any extension of the latticework of the gate. The detent is also operatively associated with a latch plate which serves to connect the one end post to a bolt, projection, or the like, on a wall to span the gate across the opening to be closed off. The bolt or projection may also be used in the latch plate to prevent the detent from moving out therefrom to ensure that the detent stays in its cord-detaining position.

In a fifth embodiment, instead of a cord being used to close off the open V-shaped openings, a ribbon is used. The take-up for the ribbon is a spool, reel, or the like, which is spring-biased to take up the ribbon onto the reel. The spring-biased reel is similar to that used in conventional measuring tape reels.

In any of the embodiments above-described, a sliding connection for the end of a latticework-end slats may be provided, to ensure that the elevation of the lower portion of the latticework remains below the critical distance above the floor, or the like, for all extensions of the latticework, so as to prevent access to the lower V-shaped openings thereby. Further, the leg brace or support may also be used in any of the above-described embodiments to provide additional structural integrity to the latticework frame.

BRIEF DESCRIPTION OF THE DRAWING

The invention will be more readily understood with reference to the accompanying drawing, wherein.

DETAILED DESCRIPTION OF THE INVENTION

Figure 1:
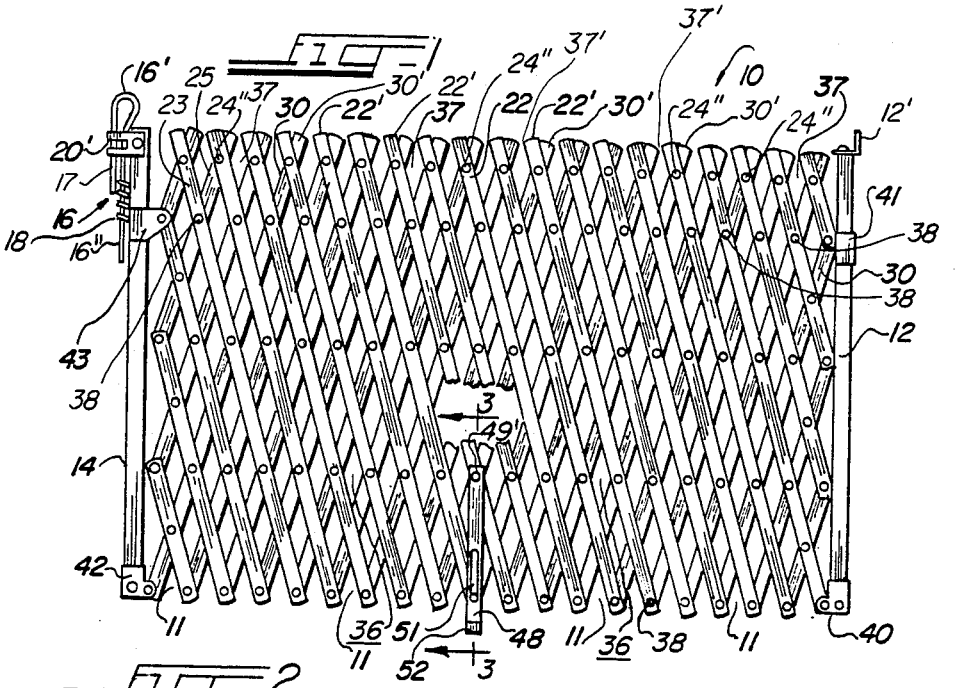
FIG. 1 is a front, elevational view showing the children's expandable gate with safety features of the present invention according to a first embodiment, with the gate in its expanded-most state.
Figure 2:
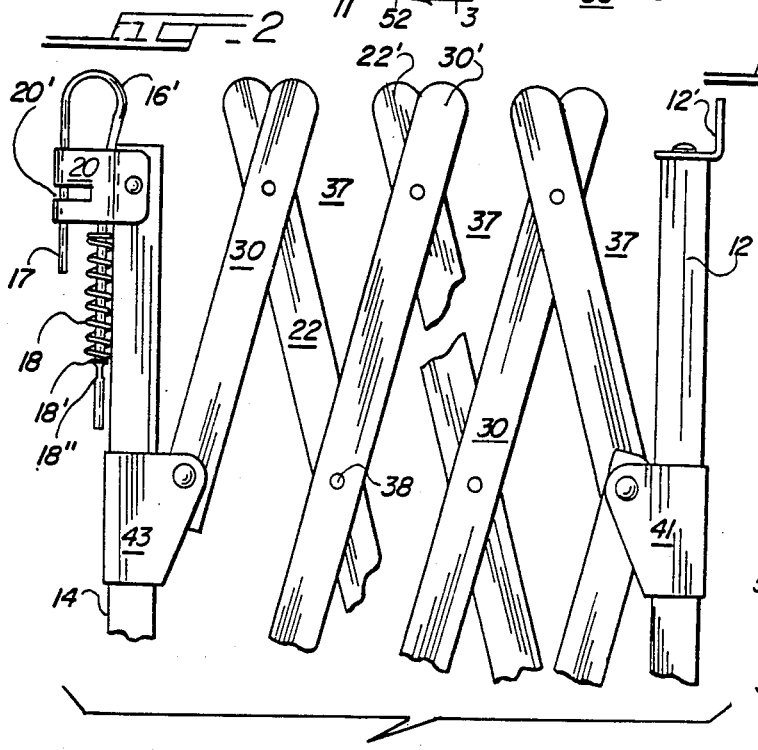
FIG. 2 is an enlarged detail view of FIG. 1.
Figure 3:
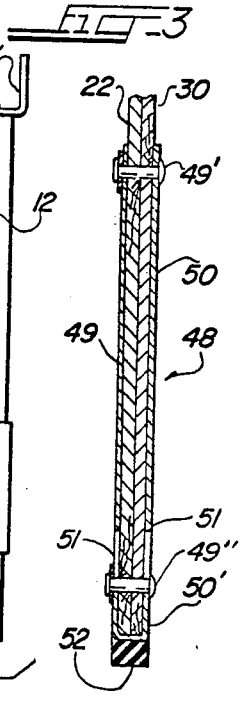
FIG. 3 is a cross-sectional view taken along line 3—3 of FIG. 1.

Referring now to the drawing in greater detail, FIGS. 1-3 show the first embodiment of children's expansion gate with safety features of the present invention. The gate 10 is an accordian-style gate that is provided with a first upstanding end post 12 and a second upstanding end post 14. The end post 12 is provided with a pair of bracket plates 12', one on the top edge surface of the end post 12 and one on the bottom edge surface not shown, for fixedly connecting the end post 12 to a wall portion, or the like, for extending the gate across an opening, entranceway, passageway, doorway, and the like, which is to be closed off to a child. The second end post 14 is provided with a spring-biased, releasable latch 16 for securing the second end post 14 to a portion of wall, or the like, on the opposite side of the passageway as the bracket plates 12', so that, when the end post 14 is pulled and extended across such passageway, the latch 16 may hold it in its extended, closing-off state. This latch 16 includes hooked member 16', and a spring 18 telescopingly and slidingly mounted over a downwardly extending leg portion 16'' of the hooked member 16'. The spring 18 has a portion 18' thereof that is of reduced diameter that cooperates with an enlarged portion 18'' in the lower end of leg portion 16'', to keep the spring in place and prevent its escape from the leg portion. Another leg portion 17 of the latch 16 extends downwardly through a hollow latch-receiving member 20 having a slot 20' for receiving therein a latch bolt, or the like, attached to the wall portion. The latch bolt is inserted into the slot 20' by pulling up on the hook member 16' until the lower end of the leg portion 17 clears the slot. After the latch bolt is inserted therein, the hook member is released and forced downwardly to its normal position via the force supplied by the spring 18.

The gate 10 is an accordian-stype gate, and has a first series of parallel, angularly-oriented elongated members or slats 22 in a first vertical imaginary plane, and a second series of parallel, angularly-oriented elongated members or slats 30 in a second vertical imaginary plane. The slats 30 extend at a different angular orientation than the slats 22, in the conventional fashion, so that each slat 22 and 30 intersects at least one other slat from the other series. Where such slats intersect, pivot pins are typically provided to pivotally connect the intersecting slats together for relative rotation between the two. The two series of slats 22 and 30 thus provide an accordian-like latticework that forms the heart of the gate. The latticework forms a number of interior, diamond-shaped openings 36 when the latticework is expanded, so as to separate the slats of each series from its most-adjacent slat of the same series, as, for example, shown in FIG. 1. Also, the latticework, when expanded, forms a series of upper, open V-shaped openings 37 defined by upper portions 23 and 25 of the slats 22 and 30', respectively, which upper portions 23 and 25 are defined between the two uppermost pivot pins 38 and 24'' along each slat, which hitherto have been a source of danger to children protected by the gate. In conventional children's expandable, accordian-style gates, the upper V-shaped openings 37 have permitted a child to insert his or her head or neck therein, which has led to entrapment, and, in some cases, death by strangulation. Thus, the gate 10 of the present invention is provided with extensions on the upper ends of the slats of the two series forming the sides of the V-shaped openings. Each extension 22' of the first series 22, and 30' of the second series 30, projects upwardly beyond the uppermost pivot pin 24 with which it is related. For example, the extension indicated by reference numeral 22' of the slat 22 of the first series projects beyond the uppermost pivot pin 24'', which pivot pin 24'' is common to two, adjacent V-shaped openings. Each uppermost pivot pin, as pivot pin 24'', is common to two mutually-adjacent V-shaped openings, so that when each extension 22' of the first series 22, or each extension 30' of second series 30, projects angularly upwardly away from its uppermost pivot pin, such extension closes off the open top of V-shaped opening directly adjacent to and closest to the leg of the V-shaped opening of which it is a part. Thus, each leg of a V-shaped opening has an upwardly projecting extension when the gate is erected for use, which projecting extension is used to close off another adjacent V-shaped opening lying closest to the leg from which the extension projects. It can, therefore, be seen that access into these V-shaped openings is prevented when the gate is expanded for closing off a space or passageway, or the like. Each non-terminal V-shaped opening is closed off at its open top by two such extensions, one from the first series 22' and one from the second series 30', with these two extensions emanating from the two adjacent V-shaped openings lying on either side thereof. The terminal V-shaped openings lying directly adjacent the end posts 12 and 14 are closed off by only one extension 22' or 30', which is possible owing to the fact that the upper ends of the end posts serve to approximately halve the area of the terminal V-shaped openings as compared with the non-terminal V-shaped openings. Each extension 22' and 30' is of sufficient length so as to ensure that the V-shaped openings are closed off, such length being that which prevents the head or neck of a 6 to 24 month old child from entering into the opening. In conjunction with the length of each upper slat extension 22' and 30', the number of slats 22 and 30 provided and their angular relationship to each other, and as well as the size of the passageway or entranceway to be closed off, will help determine the length of each extension. It is, however, important that the length of each extension 22' and 30' not be too great so as to form new V-shaped openings that are large enough to admit of a child's head or neck. Since the first series of slats lies in a different vertical imaginary plane than the second series, the length of the extensions 22' and 30' cannot interfere with any slat or other extension. Thus, the only critical determining factor for the length of each extension 22' and 30' is the requirement to prevent the formation of new, open V-shaped openings that would admit of a child's head or neck. Each elongated slat member is of such a width such that the upper extensions thereof closing off the upper V-shaped openings do not form new V-shaped openings, as clearly shown in FIG. 1, and, in essence, do not allow for any opening between directly adjacent upper extensions, such as 22' and 30', which width of each slat member also serves to help close off the upper-V-shaped openings as clearly evident in FIG. 1. These upper extensions thereby form what may be called open, incomplete upper diamond shaped openings having an upper variable vertex area 37; the open width of which is variable in accordance with the extension or contraction of the gate.

In order to ensure that a child cannot insert his or her head under the lowermost portions of the latticework when the gate is extended across a doorway, or the like, the gate of the present invention is proivded with a pair of lower pivot mounts 40 and 42. Pivot mount 40 is fixed to the lower end of the end post 12, while the pivot mount 42 is fixed to the lower end of the end post 14. The pivot mount 40 pivotally mounts the lower end of one of the slats 22, while the pivot amount 42 pivotally mounts the lower end of one of the slats 30, as clearly shown in FIG. 1. Thus, for all pivotal movements of the first and second series of slats, the lower ends of the slats are substantially kept at the same elevation above the floor or ground, for all extensions of the latticework. To allow the extension and contraction of the latticework of the gate 10, the upper portions of the lattacework are allowed to ascend and decend during contraction and extension, respectively, of the latticework. Such relative movement between the end posts and the upper portions of the latticework is achieved via sliding pivot means 41 and 43. The sliding pivot mount 41 is pivotally connected to the upper end of one of the slats 30, while the sliding pivot mount 43 is pivotally connected to the upper end of one of the slats 22, as clearly shown in FIG. 1. Each sliding pivot mount 41 and 43 is made up of a main body portion of hollow interior for telescoping mounting about its respective end post for movement therealong. In the embodiment shown in FIG. 1, the lower ends of the two terminal slats are also connected to the sliding pivot mounts. It is, of course, possible to connect the sliding pivot mounts 41 and 43 to the other ends of the slats adjacent the end posts, or to provide additional sliding pivot mounts to connect more than the two ends of the slats shown in FIG. 1. Any slat-end situated above the pivot mounts 42 may be pivotally connected to a sliding pivot mount, it being understood that such falling within the purview and scope of the present invention.

FIG. 1 also shows the provision of a lower, central leg brace or support 48. Leg support 48 is essentially a U-shaped bracket having a first leg 49 and a second leg 50, with a base 50' connecting the lower extremities of the two legs. The upper ends of the legs 49 and 50 are pivotally connected via pivot pin 49' to the upper vertex of one of the lowermost center diamond-shaped openings, such that the legs 49 and 50 sandwich therebetween portions of some of the slats 22 and 30, as shown in FIG. 3. The lower portion of each of the legs 49 and 50 is provided with a vertical slot 51 in which rides a pivot pin 49" forming the lower vertex of the same lowermost, diamond-shaped opening with which the pivot pin 49' is associated. Thus, the leg brace 48 remains vertically oriented for all movements of the latticework since each vertex of the diamond-shaped opening remains in the same vertical plane taken perpendicular to the plane of movement of the latticework during expansion. For every state of the latticework, the upper and lower vertices of each diamond-shaped opening remain vertically oriented relative to each other, while the side vertices of each diamond-shaped opening remain horizontally oriented with respect to each other. Upon extension of the latticework, the pivot pin 49" will slide upwardly in the slots 51, with the upper end of the slots 51 limiting further movement of the pivot pin 49", which thereby limits the outwardmost expansion of the latticework, while upon contraction of the latticework, the pivot pin 49" will descend therealong. The pivot pin 49" is provided with enlarged head portions at each end thereof for preventing accidental disassembly of the parts. The lowermost end of the leg brace is provided with a foot member 52 made of rubber, or the like, for resting upon the floor or ground, to support the middle section of the latticework during its expanded states. The leg brace 48 is, therefore, connected to four different slats, two of which are from the first series, and two of which are from the second series.

Figure 4:
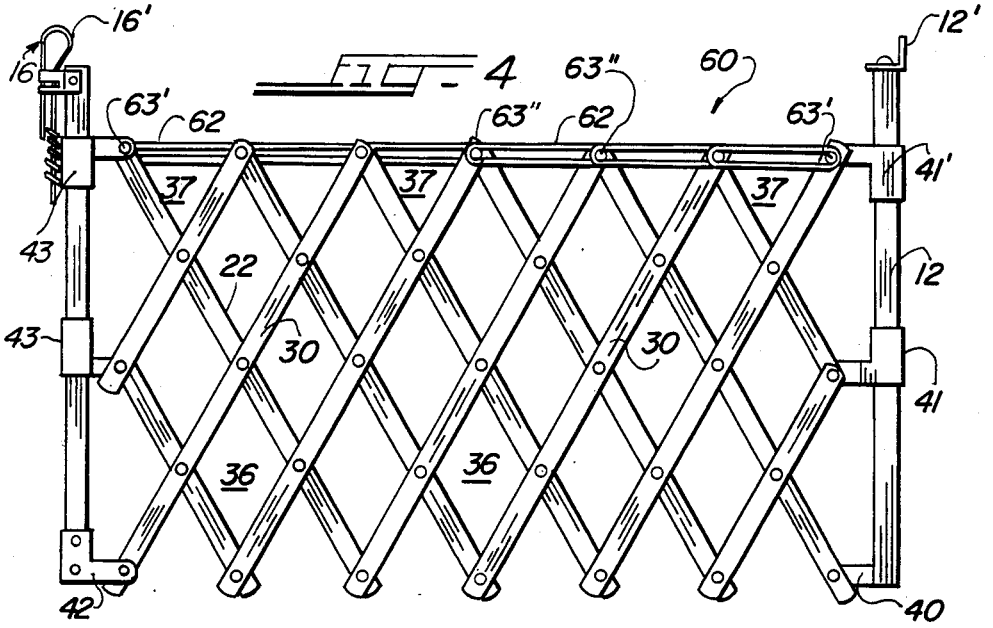
FIG. 4 is a front elevational view showing the children's expandable gate with safety features of the present invention according to a second embodiment, shown in its expanded-most state.
Figure 5:
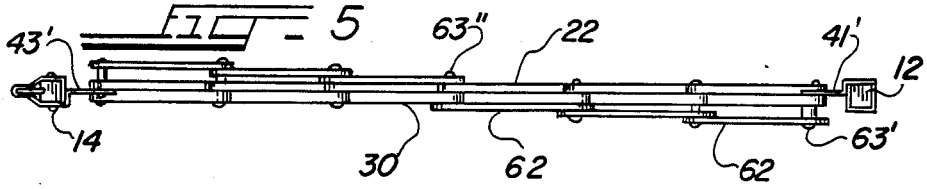
FIG. 5 is a top view of the children's expandable gate with safety features of FIG. 4.
Figure 6:
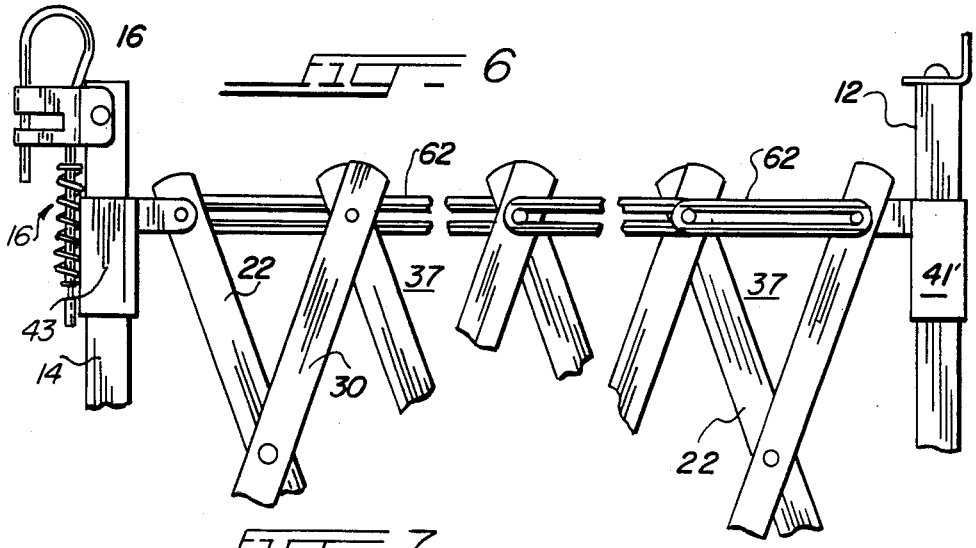
FIG. 6 is an enlarged, detail view showing the gate of FIG. 4.
Figure 7:
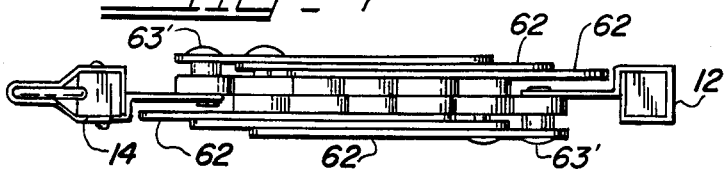
FIG. 7 is a top view showing the gate of FIG. 4 in a contracted state.

In the second embodiment of the invention, shown in FIGS. 4–7, the gate indicated by reference number 60 is provided with the similar accordian-style latticework as the gate 10 of FIG. 1. Further, in this embodiment, where the same parts as those in FIG. 1 are indicated by like reference numerals, there is provided an additional pair of sliding pivot mounts indicated by reference numerals 41' and 43'. Each sliding pivot mount 41' and 43' is connected only to the upper end of the one of the slats, though other arrangements may be employed, as described above. The upper, open V-shaped openings 37 are closed off in this embodiment by a plurality of channel members 62 supported at the uppermost portions of the latticework, as clearly shown in FIG. 4. Each channel member 62 is provided with a central, longitudinally extending channel in which are received a pair of pin members forming extensions of the pivot pins pivotally connecting together the upper intersecting ends of the slats. In the gate's expanded state, each channel member spans the distance between adjacent, pivoted upper intersecting ends of the slats, as shown in the drawing. The channel members are mounted to the latticework such that each lies in a different vertical plane parallel to the movement of the latticework than any other channel member. Further, as shown in FIG. 5, half of the channel members, closer to the end post 12 when the gate is expanded, lies on one side of the latticework, while the other half, closer to end post 14 when the gate is expanded, lies on the other side of the latticework. It can also be seen that some of the pivot pins have extension thereof that ride in more than one channel. The extension of pivot pin 63 ride in two channels. All but the terminal pivot pins 63' ride in two channels. However, the central pivot pin 63" rides in the channel members that are positioned on opposite sides of the latticework, as shown in FIG. 5. In the collapsed state of the latticework, when it is completely contracted, the channel members 62 are stacked in juxtaposed, side-by-side arrangement, as shown in FIG. 7. To ensure that each channel member may slide over an adjacent channel member on the same side of the latticework, the extensions of the pin members riding in the channels do not project outwardly more than that which would interfere with the such juxtapositioning. Thus, the extensions of pivot pin 63" do not project outwardly on either side of the latticework more than is necessary to ride in a respective channel. This ensures that the extensions of the pivot pins do not block the sliding movement of the channel members relative to each other.

The most-expanded state of the latticework of the gate 60 is reached when the pivot pins riding the channels reach the extremities of the channels, in the manner shown in FIG. 4.

The third embodiment of the gate of the present invention is shown in FIGS. 8–12, and is indicated by reference numeral 70. This gate is different from the gate of the first and second embodiments in that the top top V-shaped openings are closed off by a lever arm arrangement indicated generally by reference numeral 72. Further, the sliding pivot mounts of the first two embodiments are not shown in this embodiment to illustrate the conventional manner of mounting the latticework to the end posts. This conventional manner includes a plurality of pivot mounts 40' similar to pivot mounts 40 of FIG. 1. It is to be understood, however, that the sliding pivot mounts may be used in this embodiment so as to ensure that the lowermost portions of the latticework are elevated the same distance above the floor or ground for all extensions and contractions of the latticework, to prevent a child from having access to the space between the bottom of the latticework and the floor.

The lever arm arrangement 72 is made up, in the preferred form of this embodiment, of lever arms 74 and 76. The lever arm 76 has a distal end pivotally connected to the upper end portion of the end post 14, while the distal end of the second lever arm 74 is slidingly connected to the end post 12 via vertically oriented rod 73 and eyelet 75. The eyelet 75 is pivotally mounted to the distal end of the lever arm 74, while the rod 73 is affixed to and spaced from the end post 12 to extend a good portion of the height thereof. Thus, as the latticework expands or contracts, the eyelet 75 ascends or descends, respectively, along the rod 73. This is evident since, for the latticework to contract, the distance between the end posts must be shortened, which causes the angular rotation of the lever arm 76 about its pivoted end, which thus causes the distal end of the lever arm 74 to ride downwardly along the rod to accomodate such narrowing of the distance between the end posts.

Figure 12:
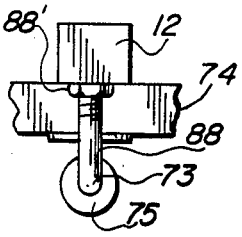
FIG. 12 is a view taken along lines 12—12 of FIG. 8.

The eyelet 75 is pivotally connected to the distal end of the lever arm 74 by pin 88 shown in FIG. 12, which pin 88 is allowed to rotate freely in a bore formed through a portion of the distal end of the lever arm 74. A nut 88' fastens the pin to the distal end, ensuring that the pin is free to rotate therewith.

Figure 10:
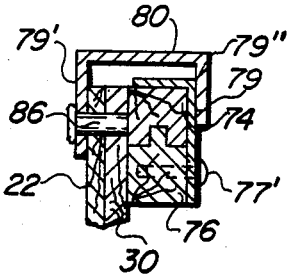
FIG. 10 is a cross-sectional view taken along line 10—10 of FIG. 8.
Figure 11:
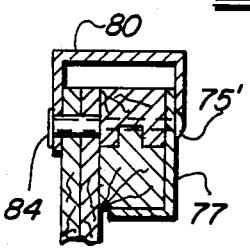
FIG. 11 is a cross-sectional view taken along line 11—11 of FIG. 8.

The ends of the two lever arms located in the center portion of the latticework overlap one another, so that the ends thereof lie one above the other, in the preferred form of this embodiment, though a side-by-side relationship may be used. The lever arm 74 is formed with an elongated groove or mortise portion extending most of the length of the lever arm, which elongated groove is formed in the lower surface face thereof when the adjacent ends of the two lever arms are positioned one above the other. The upper surface face of the lever arm 76 is provided with a projecting tenon 76' for riding in the groove of the lever arm 74, to thus provide a dovetail-type connection between the two lever arms that permits of relative sliding movement between the two. Other well-known sliding connection may be used. Affixed to each overlapping end of each lever arm is a bracket stop member. Stop member 77 is mounted by screw 77' to the overlapping end of the lever arm 74, while stop member 79 is mounted by a screw 75' to overlapping end of lever arm 76. Each bracket stop member is substantially L-shaped so that the other lever arm may ride therealong, as shown in FIGS. 10 and 11. Thus, whenever the two lever arms are pulled apart, the limit of such movement is reached when the two bracket stop members 77 and 79 abut against each other.

Figure 8:
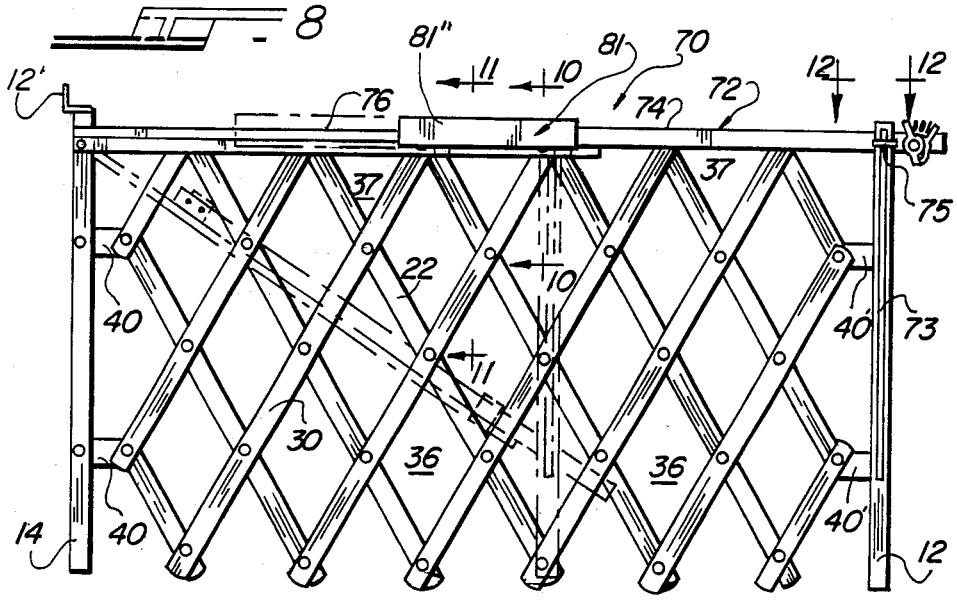
FIG. 8 is a front, elevational view showing the children's expandable gate with safety features of the present invention according to a third embodiment thereof.
Figure 9:
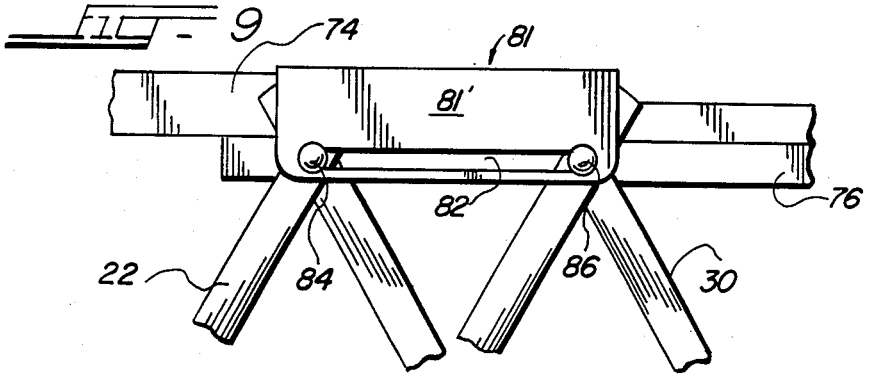
FIG. 9 is an enlarged detail view showing the locking member for the lever arm of the gate of FIG. 8.

When using the gate of FIGS. 8–12, assuming it is in the contracted state shown in phantom in FIG. 8, with the stop members 77 and 79 spaced apart, assuming the end post 14 is affixed to a wall portion of the passageway to be closed off, the end post 12 is pulled by hand across the passageway to expand the latticework thereacross. Upon such expansion, the connection between the eyelet 75 and the rod 73 will cause the distal end of the lever arm 74 connected to the rod 73 via the eyelet 75 to slide to the right when viewing FIG. 8, thus extending the lever arm 74 relative to the lever arm 76. Such relative sliding movement between the lever arms continues until the stop member 77 on the lever arm 74 is moved to abuting engagement against the stop member 79 on the lever arm 76, whereupon further expansion of the latticework causes the lever arm arrangement to pivot about the distal end of the lever arm 76 pivotally connected to the end post 14. Such rotation occurs until the latticework is in its most expanded condition, at which state the lever arms 74 and 76 are horizontally positioned, as shown in solid in FIG. 8. To ensure that the overlapping ends of the lever arms are not seen and to ensure that the lever arms stay in their horizontal orientation shown in solid line in FIG. 1, there is provided a locking bracket 81. The locking bracket 81 is a substantially U-shaped member having a first leg portion 81' and a second leg portion 81'', and an interconnecting base portion 80. The leg portion 81' is provided with a slot 82 extending a substantial distance therealong, as shown in FIG. 9. The leg portion 81' is connected to the latticework via the pivot pins 84 and 86 which pivotally connect the upper intersecting ends of four middle slats, two from the first series and two from the second series. Each pivot pin is formed with an enlarged terminal head portion to provide assemblage of parts.

As can be seen in FIGS. 10 and 11, the base portion 80 is of sufficient width to span over and beyond the thickness of the latticework constituted by the thickness of the slats of the two series of slats. This allows the leg portion 81'' to be spaced a distance away from the slats 30, so as to leave space therebetween for the reception therein of the two overlapping end portions of the lever arms 74 qnd 76. This space is just sufficient to receive the overlapping end portions with attached stop numbers 77 and 79 in a snug fashion, as shown in FIGS. 10 and 11, to thereby detain them and, therefore, the lever arms in the horizontal orientation assumed during the full expansion of the latticework. The groove or slot 82 with the enlarged terminal head portions of the pivot pins 84 and 86 permit the contraction of the latticework as well as its expansion, which otherwise would not be possible if relative movement could not occur between it and the pivot pins 84 and 86. Further, when the latticework is in its most-contracted state, the locking bracket 79 extends substantially across most of the length of the latticework. In this state, the locking bracket can serve as a handle by which to transport the gate. The sliding movement of the overlapping ends also allows for the minor adjustments of the length of the gate to adapt to differently-sized openings, the securing member at the end of the second lever arm thereby being accomodated by a variety of differently-sized entranceways, and the like. This adjustment capability occurs while the lever arm arrangement is in its upper, horizontally positioned state.

Figure 13:
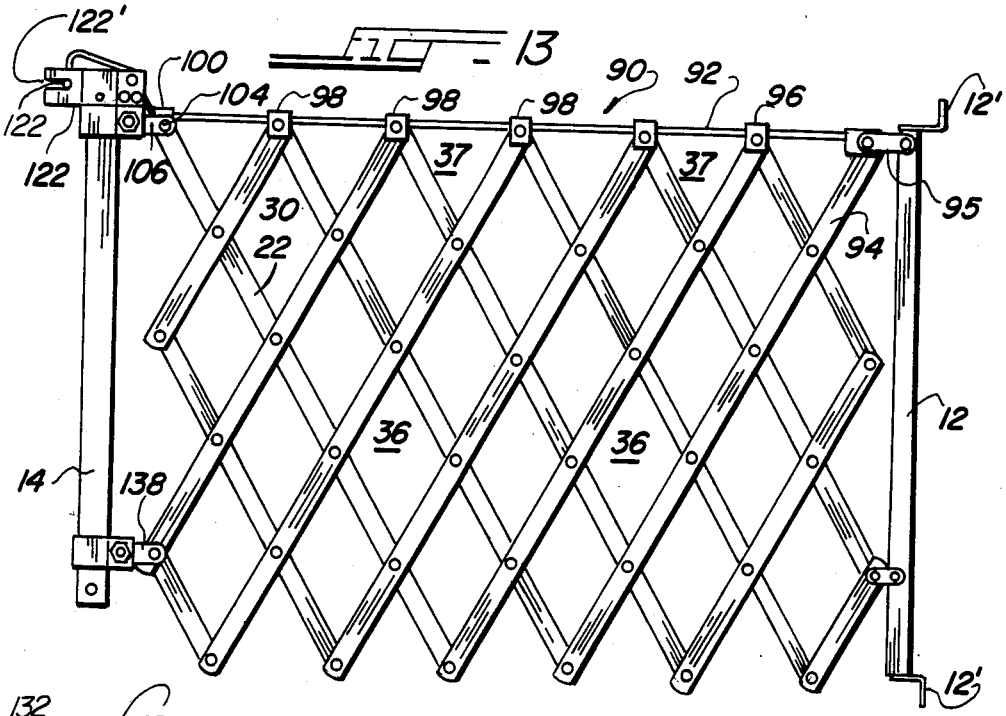
FIG. 13 is a front elevational view of the fourth embodiment of the children's expandable gate with safety features of the present invention.
Figure 14:
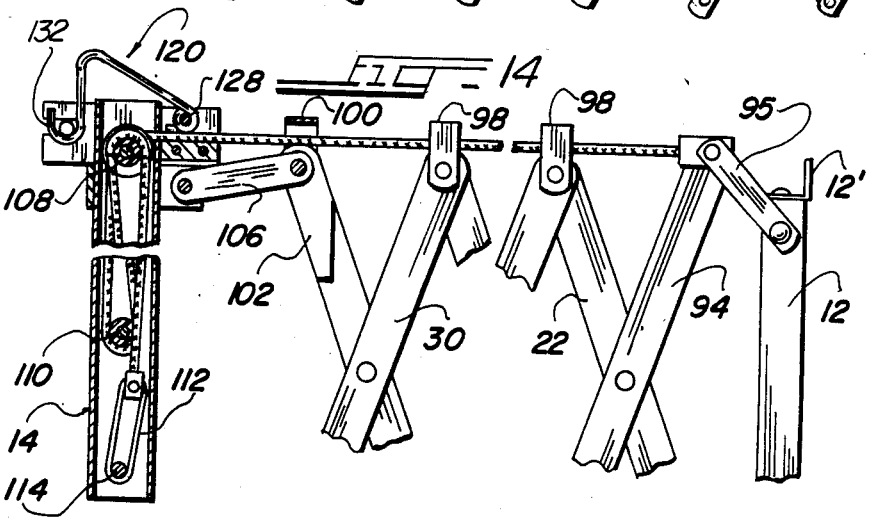
FIG. 14 is a cross-sectional view taken along line 14—14 of FIG. 15.
Figure 15:
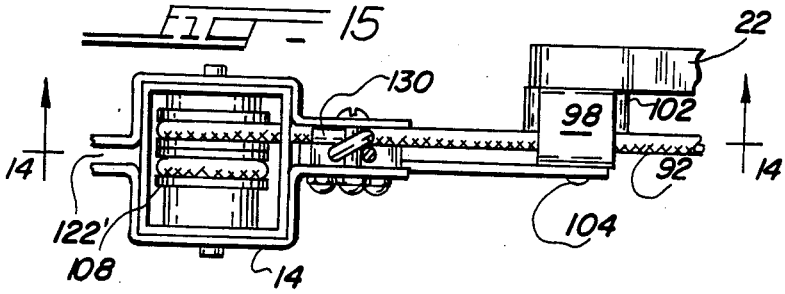
FIG. 15 is a top view of the children's expandable gate of FIG. 13.

The fourth embodiment of the gate of the present invention is shown in FIGS. 13–15, and is indicated generally by reference numeral 90. In this embodiment, the upper V-shaped openings 37 are closed off by a cord or rope 92 having a distal end fixedly connected to the upper end of slat 94, which upper end is the right terminal upper end in forming the V-shaped openings adjacent the end post 12, when viewing FIG. 13. The distal end of the cord is preferably secured to this upper end of the slat 94 by a U-shaped attaching bracket 96. Bracket 96 is provided with a hole (not shown) facing toward end post 14, through which hole the distal end of cord is inserted and prevented from escape therefrom by an enlarged cap, typically made of metal, which prevents the distal end of the cord from being pulled out of the hole of the bracket 96 when the gate is expanded. Bracket 96 is provided with holes on the ends of each leg portion thereof, so that the pivot pin 96' pivotally connects the upper end of the slat to the bracket 96. A hinge plate 95 pivotally connects the upper end of slat 94 to the end post 12.

A plurality of other U-shaped brackets 98 are also provided, which brackets 98 are connected to the upper ends of the slats forming the right sides, when viewing FIG. 13, of the plurality of V-shaped openings 37. Each bracket 98 has its side leg portions thereof formed with aligned holes through which passes the pivot pin interconnecting the upper ends of the slats of the V-shaped openings to mount each bracket to its respective upper end. Each bracket 98 sandwiches between its leg portions the upper end of its respective upper end of a slat from the series of slats 30, so that the base portion of each bracket 98 is spaced above the uppermost portion of its respective upper end of the slat, through which extends the cord 92. One additional bracket 100 is also provided, which bracket is pivotally connected to the partial slat 102 formed in front of the slat directly therebehind from the series of slats 22. This partial slat 102 is used so as to position the bracket 100 in the same vertical plane as the other brackets 98 and 96. The bracket 100 sandwiches the upper end of this partial slat 102 between its two leg portions, and is pivotally mounted thereto by pivot pin 104, which also pivotally mounts thereto the upper end of the slat 22 directly behind the partial slat 102. Hinge plate 106 connects the upper end of the partial slat 102 to the end post 14. It can, therefore, be seen that the cord 92 is constrained by the brackets 96, 98, and 100, so that, as the end post 14 is expanded or contracted, the cord 92 will remain directly above the upper ends of their respective slats, to close off the open V-shaped openings 37, to thereby prevent access therein and thus prevent the hazardous conditions heretofore prevailing. In order to allow the length of the cord 92 to increase or decrease when the latticework is expanded or contracted, respectively, a block-and-tackle type take up supply is provided which pays out the cord during expansion of the latticework, and takes up the cord during contraction. This take-up supply is indicated generally by reference numeral 106 in FIG. 14 and is mounted in the hollow interior of the end post 14. The supply includes a plurality of pulleys 108 and 110 forming a block-and-tackle type device. The cord is wrapped about these pulleys with the end of the cord, in the interior of the end post 14, being affixed to a resilient biasing member 112, which, in the form shown in FIG. 14, is a resilient band secured at one end to a shaft 114, and at its other end to the end of the cord within the end post 14. It can, therefore, be seen that, when the end post 14 is pulled away from the end post 12 during expansion of the latticework to close off a passageway, or the like, the length of cord spanning the distance between the end post is lengthened accordingly to accomodate such expansion. Contrarily, when the latticework is contracted, the cord is taken up by the supply thereof, owing to the biasing force supplied by the biasing member 112. The upper V-shaped openings are, therefore, closed off automatically for any extension of the gate 90.

The gate 90 is also provided with a detent lever 120, which serves to hold the cord extended for any extension of the latticework. This is desirable so that the latticework may be extended to any desired length, and not just the fully-expanded state where the latch plate 122 receives a wall-attached bolt, such as bolt 124 shown in FIG. 13. Thus, the latticework can be opened up to any desired length while still making sure that the latticework will not be pulled closed by the force of the biasing member 112 of the take-up 106. Detent lever 120 includes pivoted leg portion 126 pivoted by pin 128 to a plate extension of the upper portion of the end post 14. The pivoted end of this leg portion is curled or spiralled about the pivot pin therefor, leaving a trailing end 130. This trailing end 130, best seen in FIG. 15, is forced into locking engagement with the portion of the cord 92 positioned thereunder when the detent lever 120 is rotated in the counterclockwise direction, when viewing FIG. 13. When rotated clockwise, this trailing end 130 is forced away from the cord, allowing the cord to move, so as to lengthen or shorten, as the case warrants. When the detent lever is in its locking position, the lowermost portion of its hooked end 132 is positioned below the latch plate's bolt-receiving channel 122', so that when a bolt 122 is inserted through such channel, the detent lever is prevented from escaping therefrom, to thus securely lock the detent lever. However, the detent lever 120 will still restrain movement of the cord when such locking bolt is not emplaced in the channel owing to the force of friction between the end 130 and the cord itself.

The gate 90 is also provided with the conventional lower pivot plates 136 and 138. Though the gate 90 is shown with non-sliding pivot mounts, it is to be understood that sliding pivot mounts such as mounts 41 and 43 of FIG. 1, may be employed in this embodiment as well. Such sliding mounts would not interfere with the operation of the latticework or the extension and contraction of the cord, since the brackets 98 and 100 are allowed some pivotal movement about the ends of the respective slats with which they are associated. Thus, the pivot mounts 95 and 106 may be replaced with sliding mounts such as 41 and 43 of FIG. 1.

Figure 16:
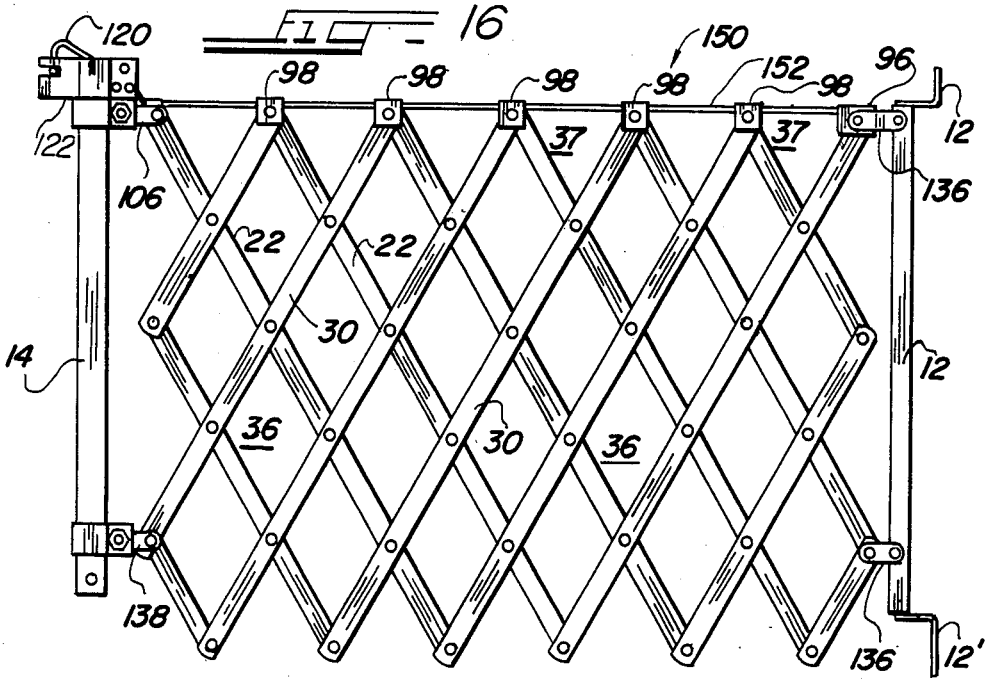
FIG. 16 is a front elevational view of the fifth embodiment of the children's expandable gate with safety features of the present invention.
Figure 17:
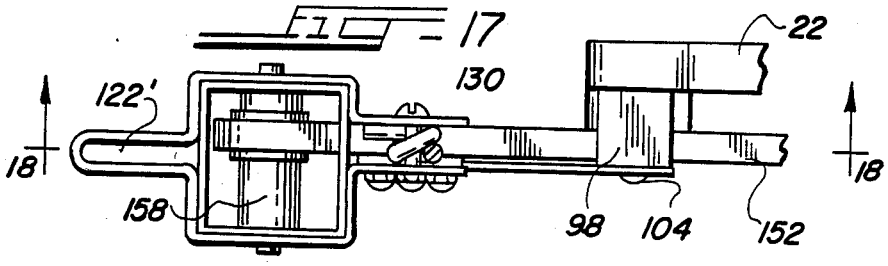
FIG. 17 is a top view of the gate of FIG. 16.
Figure 18:
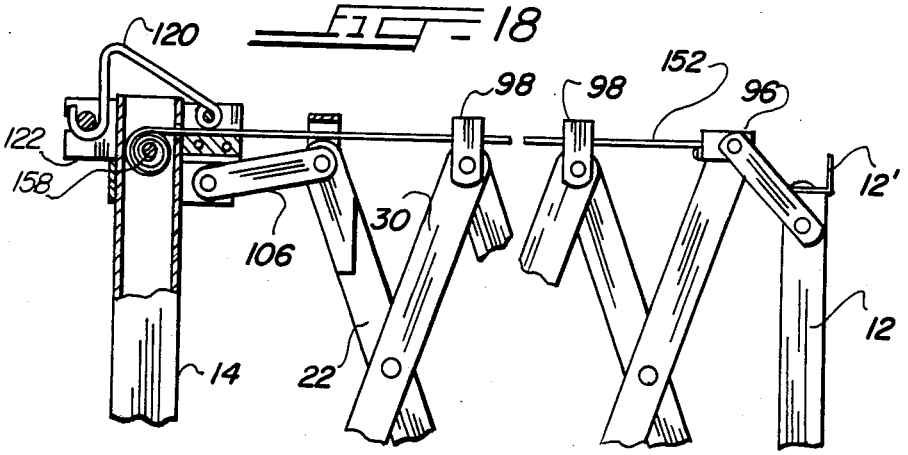
FIG. 18 is a cross-sectional view taken along line 18—18 of FIG. 17.

The fifth embodiment of the gate of the present invention is shown in FIGS. 16–18, and is indicated by reference numeral 150. The gate of FIGS. 16–18 is similar to that of FIGS. 13–15, with the exception that instead of a cord or rope closing off the open upper portions of the V-shaped openings 37, a flexible ribbon is used instead. The ribbon 152, as the cord 92 of the previous embodiment, passes through a plurality of brackets 96, 98, and 100 at the upper ends of the slats of the series of slats 30, which upper ends form part of the boundaries of the V-shaped openings. Instead of a block-and-tackle type take-up supply, the gate 150 is provided with a take-up spindle 158 that is provided with a spiral spring, or the like, to urge the spindle into the take-up winding direction, as in the conventional tape-measuring reel device. The detent lever 120 is provided, as in the previous embodiment of the cord, and is provided with the end 130 for locking the ribbon in place to prevent further paying out or taking up thereof, as described above.

The above-described and shown embodiments of the present invention have been shown by way of example, and are not to be construed as the only forms and modes that the invention may take. Other forms and modes are to be considered within the scope, purview and spirit of the invention as set out in the appended claims. Further, to provide compliance with the requirements that the diamond-shaped openings of the expandable gate not admit of a testing template designed to indicate the size of a child's head and neck between the ages of 6 and 24 months, the diamond-shaped openings of each of the embodiments of the invention are so dimensioned as to preclude passage of such testing template therethrough, in order to prevent the head or neck of a child from gaining access therein. Such is accomplished by selecting the appropriate number of slats of the first and second series of slats 22 and 30, within the constraint imposed by the range of lengths of openings to be closed off.

Further, in the case of the first embodiment, the lower V-shaped openings, indicated by reference numerals 11 in FIG. 1, may be provided with projecting extensions similar to extensions 22' and 30' of the upper V-shaped openings. These lower slat extensions may be used in any of the other four embodiments of gate of the invention as well, and may be used in combination with the sliding mount connections for the upper portions of the latticework. Preferably, however, since regulations require that the uppermost portion of the bottom openings of the latticework of the gate be below the prescribed distance above the floor, these lower slat extensions are used in conjunction with the sliding mounting brackets that keep the lower portions of the latticework at an approximate constant elevation above the floor.

What is claimed is:

1. In a children's expandable gate comprising:

a first upstanding end post for connection to a wall, or the like, from which the gate expands and contracts for closing off an opening;

a second upstanding end post parallel to said first end post and spaced therefrom for movement toward and away from said first end post, said second upstanding end post having means for securing the gate to a wall or the like, so that the gate spans the opening, and the like which is to be closed off;

a first series of parallel, angularly-disposed and elongated members mounted between said first and second end posts;

a second series of parallel, angularly-disposed elongated members also mounted between said end posts, said second series extending at a different angular extension than said first series so that said members of said second series crisscross said members of said first series;

first means pivotally connecting said first series and said second series together, said first means pivotally securing each of said elongated members of said first series to at least one of said elongated members of said second series, and pivotally securing each of said elongated members of said second series to at least one of said elongated members of said first series, so that said first and second series provide an expandable and contractable open latticework defining a plurality of bounded diamond-shaped openings in the body of the latticework, and a plurality of open, V-shaped cutouts at the top of the latticework, each said V-shaped cutout being defined by an uppermost portion of one of said elongated members of said first series, and an uppermost portion of one of said elongated members of said second series, said uppermost portions being pivotally connected together to form the vertex of said V-shaped cutout;

second means for connecting at least one of the lower end and upper end of at least one of said elongated members of said latticework to at least one of said first and second end posts for movement relative to said at least one of said first and second end posts, to thereby establish connection between each end of said latticework and its adjoining, respective end post;

third means for connecting at least one of the lower end and upper end of at least one other of said elongated members of said latticework to at least the other of said first and second end posts for movement relative to at least the other of said first and second end posts, to thereby establish connection between each end of said latticework and its adjoining, respective end post;

the topmost portion of each of said uppermost portions of said elongated members from said first series, forming a leg of one V-shaped cutout, being pivotally connected to the topmost portion of said uppermost portion of an elongated member from said second series, forming a leg of another V-shaped cutout directly adjacent to said one V-shaped cutout and directly adjacent to said elongated member from said first series;

means for pivotally connecting respective said topmost portions together, wherein the improvement comprises:

fourth means operatively associated with each V-shaped cutout for closing off each of said plurality of open, V-shaped cutouts at the uppermost part of said latticework, so as to prevent a child's head or neck from being caught in any of said V-shaped cutouts;

said fourth means comprising extensions of said uppermost portions of said elongated members of said first and second series forming the legs of said V-shaped cutouts; each said extension projecting beyond said means for pivotally connecting said topmost portions together such that the uppermost tip of each said extension is at a higher elevation than said means for pivotally connecting said topmost portions together when said latticework is fully expanded for use, and such that, when the latticework is in its expanded condition to close off an opening, each said uppermost tip of each said extension having a portion that lies at least substantially adjacently to the same vertical plane as said vertex of the V-shaped cutout with which the respective extension is associated for substantially closing off the open top of its respective V-shaped cutout such that the lateral distance between said uppermost tip portion of each said extension of said first series and the uppermost tip portion of said extension of said second series directly adjacent thereto in less than the minimum transverse dimension of a standard test template representative of the neck and head of a six-month old child; said vertical plane being transverse to the plane parallel to the direction in which said latticework is expanded and contracted;

a support leg for the middle portion of said latticework to provide support therefor, said support leg having a top end portion pivotally connected to a portion of one of said plurality of elongated members of the first series, and also pivotally connected to a portion of one of said plurality of the second series, said portions of each being juxtaposed against each other and forming the uppermost vertex of a lowermost one of said plurality of diamond-shaped openings; and a bottom end portion having a groove formed therein; said first means comprising a pivot pin means having an enlarged head portion for riding in said groove, said pivot pin means pivotally connecting a lower end portion of an elongated member of said first series with a lower end portion of an elongated member of said second series, said lower end portions forming the lowermost vertex of said diamond-shaped opening, said lowermost vertex and said uppermost vertex lying substantially in the same vertical plane for all extensions and contractions of said latticework.

2. In a children's expandable gate comprising:

a first upstanding end post for connection to a wall, or the like, from which the gate expands and contracts for closing off an opening;

a second upstanding end post parallel to said first end post and spaced therefrom for movement toward and away from said first end post, said second upstanding end post having means for securing the gate to a wall or the like, so that the gate spans the opening, and the like, which is to be closed off;

a first series of parallel, angularly-disposed and elongated members mounted between said first and second end posts; a second series of parallel, angularly-disposed elongated members also mounted between said end posts, said second series extending at a different angular extension than said first series so that said members of said second series crisscross said members of said first series;

first means pivotally connecting said first series and said second series together, said first means pivotally securing each of said elongated members of said first series to at least one of said elongated members of said second series, and pivotally securing each of said elongated members of said second series to at least one of said elongated members of said first series, so that said first and second series provide an expandable and contractable open latticework defining a plurality of bounded diamond-shaped openings in the body of the latticework, and a plurality of open, V-shaped cutouts at the top of the latticework, each said V-shaped cutout being defined by an uppermost portion of one of said elongated members of said first series, and an uppermost portion of one of said elongated members of said second series; second means for connecting at least one of the lower end and upper end of at least one of said elongated members of said latticework to at least one of said first and second end posts for movement relative to said at least one of said first and second end posts, to thereby establish connection between each end of said latticework and its adjoining, respective end post;

third means for connecting at least one of the lower end and upper end of at least one other of said elongated members of said latticework to at least the other of said first and second end posts for movement relative to at least the other of said first and second end posts, to thereby establish connection between each end of said latticework and its adjoining, respective end post; wherein their improvement comprises:

a support leg for the middle portion of said latticework to provide support therefor and for the prevention of movement of the lower portion of the expandable gate relative to the floor over which it is extended, said support leg having a top end portion and a bottom end portion spaced vertically from said top end portion; one of said top and bottom end portions being pivotally connected to a first portion of at least one elongated member at least partially forming a vertex of one of said plurality of diamond-shaped openings, and the other of said top and bottom end portions being slidingly connected to a second portion of at least one other elongated member which second portion at least partially forms a vertex of another one of said plurality of diamond-shaped openings; and means for slidingly connecting said other of said end portions to said second portion of said at least one other elongated member; said top and bottom end portions lying substantially in a vertical plane such that said portions to which said top and bottom end portions are connected form the vertices of diamond-shaped openings in vertical alignment; and vertically-movable floor gripping means projecting downwardly from said bottom end portion for gripping the floor therebelow when said latticework is expanded to close off an opening, said means for gripping moving in an up and down manner along with said top and bottom end portions when said latticework is, respectively, contracted and expanded;

said support leg being a substantially U-shaped member having a base portion, a first upstanding leg portion, and a second upstanding leg portion, each of said leg portions projecting upstanding from different ends of said base portion, said base portion comprising said means for gripping the floor when said safety gate is mounted across an opening and above a floor when said safety gate is expanded to an outward position; said top end portion being defined by the upper portions of both of said first and second leg portions, and said bottom end portion being defined by the lower portions of said first and second leg members; said upper and lower portions of said first leg member being respectively connected to said first and second portions of elongated members of said first series, and said upper and lower portions of said second leg member being respectively connected to said first and second portions of elongated members of said second series, said base portion extending below a plane containing therein the lowermost portions of said elongated members of both said first and second series, so that said means for gripping the floor may perform its function of preventing the outward bowing movement of the center portion of the safety gate from its contact with the floor in order to prevent a child from falling down the stairs, or the like.

3. The improvement according to claim 2, wherein said top end portion is pivotally connected to said first portion of one of said plurality of elongated members of said first series, and said bottom end portion is slidingly connected to said second portion of one of said elongated members also from said first series.

4. In a children's expandable gate comprising: a first upstanding end post for connection to a wall, or the like, from which the gate expands and contracts for closing off an opening;

a second upstanding end post parallel to said first end post and spaced therefrom for movement toward and away from said first end post, said second upstanding end post having means for securing the gate to a wall or the like, so that the gate spans the opening, and the like which is to be closed off;

a first series of parallel, angularly-disposed and elongated members mounted between said first and second end posts;

a second series of parallel, angularly-disposed elongated members also mounted between said end posts, said second series extending at a different angular extension than said first series so that said members of said second series crisscross said members of said first series;

first means pivotally connecting said first series and said second series together, said first means pivotally securing each of said elongated members of said first series to at least one of said elongated members of said second series, and pivotally securing each of said elongated members of said second series to at least one of said elongated members of said first series, so that said first and second series provide an expandable and contractable open latticework defining a plurality of bounded diamond-shaped openings in the body of the latticework, and a plurality of open, V-shaped cutouts at the top of the latticework, each said V-shaped cutout being defined by an uppermost portion of one of said elongated members of said first series, and an uppermost portion of one of said elongated members of said second series, said uppermost portions crossing to form the vertex of said V-shaped cutout;

second means for connecting at least one of the lower end and upper end of at least one of said elongated members of said latticework to at least one of said first and second end posts for movement relative to said at least one of said first and second end posts, to thereby establish connection between each end of said latticework and its adjoining, respective end post;

third means for connecting at least one of the lower end and upper end of at least one other of said elongated members of said latticework to at least the other of said first and second end posts for movement relative to at least the other of said first and second end posts, to thereby establish connection between each end of said latticework and its adjoining, respective end post; wherein the improvement comprises:

fourth means operatively associated with each V-shaped cutout for closing off each of said plurality of open, V-shaped cutouts at the uppermost part of said latticework, so as to prevent a child's head or neck from being caught in any of said V-shaped cutouts;

said fourth means comprising extensions of said uppermost portions of said elongated members of said first and second series forming the legs of said V-shaped cutouts, each said extension defining a topmost portion such that, when the latticework is in its expanded condition to close off an opening, each said tip portion of each said extension comprising a portion that lies at least substantially adjacently to the same vertical plane as said vertex of the V-shaped cutout with which the respective extension is associated for substantially closing off the open top of its respective V-shaped cutout such that the lateral distance between said tip portion of each said extension of said first series and the tip portion of said extension of said second series directly adjacent thereto is less thin the minimum transverse dimension of a test template representative of the neck and head of a six-month old child; said vertical plane being transverse to the plane parallel to the direction in which said latticework is expanded and contracted; and means for limiting the outward-most expansion of said latticework.

5. The combination according to claim 4, wherein each said elongated member has a width at least at said extension thereof such that, when said latticework is in its most-expanded state, the extension of each said elongated member from said first series and the extension of an elongated member from said second series directly adjacent thereto at least partially overlap each other so that there will not be formed a V-shaped opening therebetween that may pose a danger to child.

* * * * *